US011040549B2

(12) United States Patent
Ando

(10) Patent No.: US 11,040,549 B2
(45) Date of Patent: Jun. 22, 2021

(54) PORTABLE PRINTER

(71) Applicant: Seiko Instruments Inc., Chiba (JP)

(72) Inventor: Norihisa Ando, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 16/654,588

(22) Filed: Oct. 16, 2019

(65) Prior Publication Data

US 2020/0130376 A1 Apr. 30, 2020

(30) Foreign Application Priority Data

Oct. 30, 2018 (JP) ..... JP2018-203473

(51) Int. Cl.
*B41J 3/36* (2006.01)
*B41J 29/02* (2006.01)
*B41J 2/32* (2006.01)

(52) U.S. Cl.
CPC ..... *B41J 3/36* (2013.01); *B41J 29/02* (2013.01); *B41J 2/32* (2013.01)

(58) Field of Classification Search
CPC ..... B41J 3/36; B41J 29/02; B41J 2/32
See application file for complete search history.

(56) References Cited

U.S. PATENT DOCUMENTS 5,821,482 A * 10/1998 Ootani ..... H01H 13/705 200/5 A
8,482,587 B2 7/2013 Sakaino

FOREIGN PATENT DOCUMENTS

| | | | |
|---|---|---|---|
| EP | 1559563 | A1 | 8/2005 |
| EP | 2979883 | A1 | 2/2016 |
| EP | 3165375 | A1 | 5/2017 |
| JP | 2008216033 | A | 9/2008 |
| JP | 2014-188707 | A | 10/2014 |

OTHER PUBLICATIONS

Extended European Search Report in Europe Application No. 19205824.6, dated Apr. 9, 2020, 10 pages.

* cited by examiner

*Primary Examiner* — Jason S Uhlenhake
(74) *Attorney, Agent, or Firm* — Brinks Gilson & Lione

(57) ABSTRACT

A portable printer includes a casing configured to receive a recording medium; a head configured to perform printing on the recording medium; a platen roller, which is arranged so as to be opposed to the head, and is configured to convey the recording medium while sandwiching the recording medium together with the head; a button, which is provided on the casing, and is configured to perform operation of separating the head and the platen roller from each other; and a stepped portion, which is formed on the casing along a peripheral edge of the button, and protrudes so that an inner side of the casing is higher than an outer side of the casing.

8 Claims, 7 Drawing Sheets

PORTABLE PRINTER

RELATED APPLICATIONS

This application claims priority to Japanese Patent Application No. 2018-203473, filed on Oct. 30, 2018, the entire content of which is incorporated herein by reference.

BACKGROUND OF THE INVENTION

1. Field of the Invention

The present invention relates to a portable printer.

2. Description of the Related Art

There have been known portable printers configured to output (print) information, which is input to a host device (for example, personal digital assistant (PDA)), at visiting places or the like. The portable printer is sometimes used under an environment such as outdoors in which drip-proof performance is required. The portable printer includes a casing, and a movable component such as a button provided on the casing (for example, an eject button to be operated to open an open/close cover). For example, under the environment in which drip-proof performance is required, there is a fear in that rainwater during outdoor work, or liquid such as water adhering to a hand of a user flows into the printer through a boundary portion between the casing and the movable component, and adheres to, for example, a roll sheet or a board. Adhesion of the liquid to, for example, the roll sheet or the board causes printing failure or a malfunction of an electronic component. Therefore, the portable printer is required to have the structure capable of preventing inflow of the liquid into the printer. As such a printer, there has been known a printer having a configuration that makes it difficult for water to flow into a housing through a gap between the eject button and the housing. In the printer having this configuration, a waterproof intimate-contact surface is formed at a peripheral edge portion of the eject button, and the eject button can be urged so that the waterproof intimate-contact surface is held in intimate contact with an inner wall surface of the housing.

However, in the printer having the above-mentioned configuration, the eject button is assembled from an inner side of the housing, and hence a water-drop sometimes remains on a step between the housing and the eject button. Further, in the printer having the above-mentioned configuration, the eject button cannot overlap the housing. Thus, it is difficult for the eject button to function as an umbrella configured to prevent inflow of the waterdrop. There is a risk in that the water remaining on the step may flow into the housing when the eject button is pushed.

Therefore, in this type of field, it has been desired a portable printer capable of suppressing inflow of liquid into the printer from an outside.

SUMMARY OF THE INVENTION

According to one embodiment of the present invention, there is provided a portable printer, including: a casing configured to receive a recording medium; a head configured to perform printing on the recording medium; a platen roller, which is arranged so as to be opposed to the head, and is configured to convey the recording medium while sandwiching the recording medium together with the head; a button, which is provided on the casing, and is configured to perform operation of separating the head and the platen roller from each other; and a stepped portion, which is formed on the casing along a peripheral edge of the button, and protrudes so that an inner side of the casing is higher than an outer side of the casing.

In the above-mentioned portable printer according to the one embodiment, wherein in an assumed carriage posture in which a depression surface of the button is positioned beside a front wall of the casing, the stepped portion is formed at least at a lowermost portion of an edge portion of the casing along a vertical direction of the button.

In the above-mentioned portable printer according to the one embodiment, wherein in the assumed carriage posture, the stepped portion is formed across the entire edge portion along the vertical direction of the button.

In the above-mentioned portable printer according to the one embodiment, wherein in the assumed carriage posture, the button is provided in a boundary portion between the front wall and a side wall of the casing.

In the above-mentioned portable printer according to the one embodiment, wherein the stepped portion includes: a landing adjacent to an outer surface of the casing; and a protruding wall protruding from the landing.

In the above-mentioned portable printer according to the one embodiment, wherein a height of the protruding wall is larger than a width of the landing.

In the above-mentioned portable printer according to the one embodiment, wherein a width of the protruding wall is larger than a width of the landing.

In the above-mentioned portable printer according to the one embodiment, wherein a gap is defined between the protruding wall and the button, and wherein the width of the landing is larger than a width of the gap.

In the above-mentioned portable printer according to the one embodiment, wherein an angle formed between the landing and the protruding wall is an obtuse angle.

The above-mentioned portable printer according to the one embodiment, further including: a cover configured to support the platen roller in a freely rotatable manner; and a lock mechanism, which is provided in the casing, and is configured to lock the platen roller, wherein the casing supports the head, and wherein the button is capable of undoing locking of the lock mechanism.

DETAILED DESCRIPTION OF THE PREFERRED EMBODIMENTS

Figure 1:
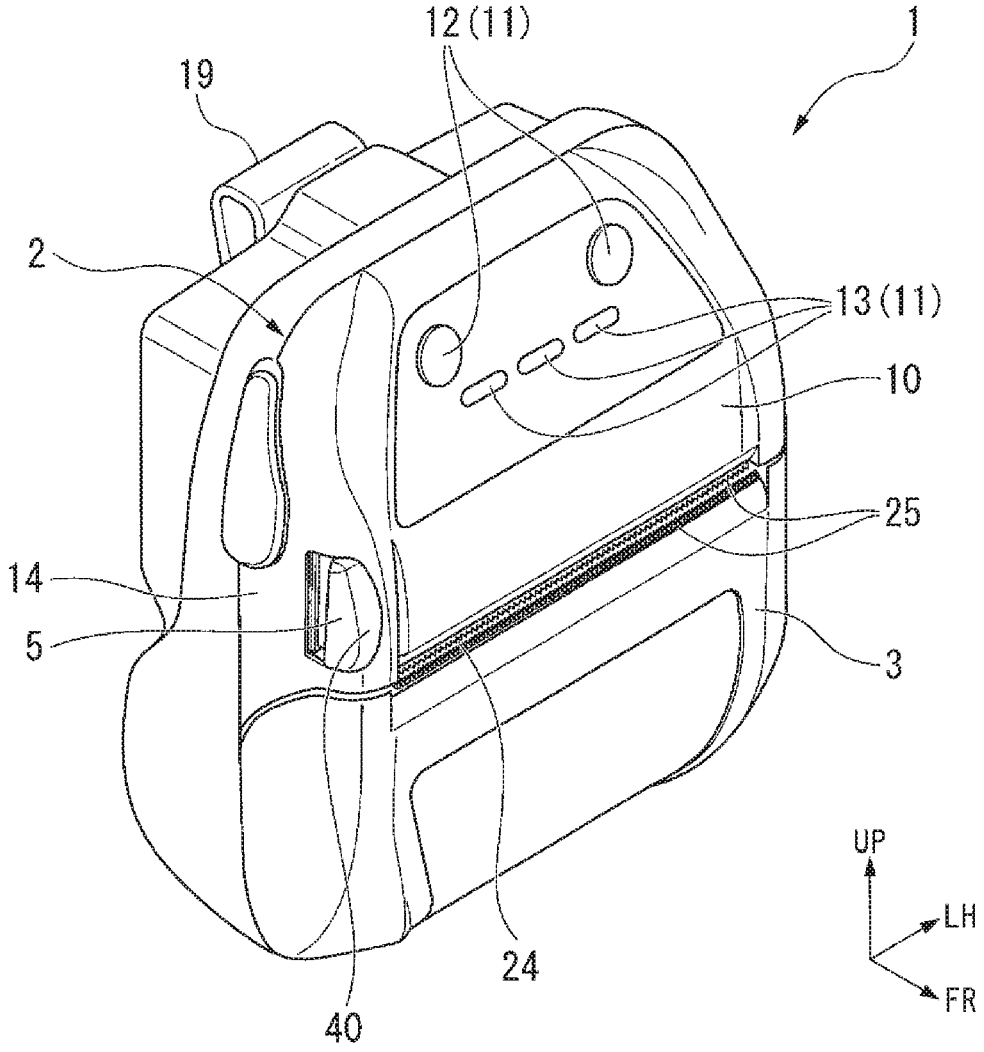
FIG. 1 is a perspective view of a portable printer according to an embodiment of the present invention under a state in which a cover takes a closing position.

Now, an embodiment of the present invention is described with reference to the drawings. In the following embodiment, as a portable printer, there is exemplified a thermal printer capable of being carried by a user. In the drawings to be referred to in the following description, in order to illustrate each component with a recognizable size, a contraction scale of each component is changed as appropriate. In the drawings, FR, LH, and UP represent a front side, a left side, and an upper side of the portable printer, respectively. In the following embodiment, a posture of the thermal printer assumed during carrying of the thermal printer, which has front-and-rear, up-and-down, and right-and-left directions as illustrated in FIG. 1, is referred to as "an assumed carriage posture", and description is made of the thermal printer in the assumed carriage posture.

As illustrated in FIG. 1, a thermal printer 1 includes a casing 2, a cover 3, a printing unit 4 (see FIG. 3), and a button 5. The thermal printer 1 is configured to print information on a recording sheet P being a recording medium (see FIG. 4), and to deliver the recording sheet P through a delivery port 24.

For example, the casing 2 is made of a resin material such as polycarbonate, or a metal material. An upper portion of the casing 2 is formed into a rectangular parallelepiped shape to include a front wall 10 and side walls 14. A lower portion of the casing 2 is formed into a box-like shape to have an opening portion 9 (see FIG. 4) opens forward.

An operation unit 11 is provided in an upper portion of the front wall 10 of the casing 2. The operation unit 11 is configured to perform various operations on the thermal printer 1. The operation unit 11 includes various function switches 12 such as a power switch and a FEED switch, and various lamps 13 such as a POWER lamp configured to inform ON/OFF information of the power switch, and an ERROR lamp configured to inform, for example, an error of the thermal printer 1.

Figure 4:
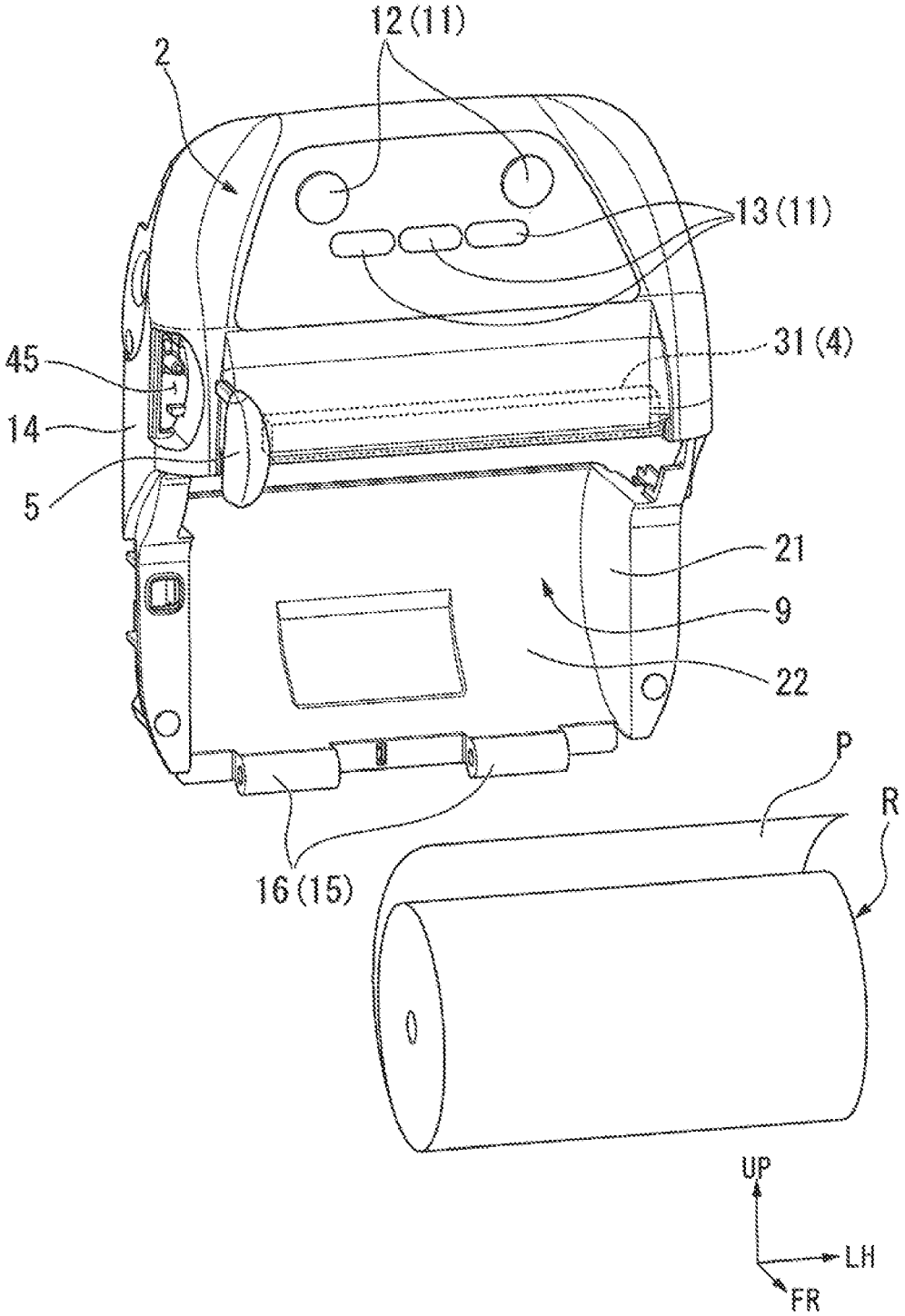
FIG. 4 is an exploded perspective view of the portable printer according to the embodiment from which the cover is removed.

As illustrated in FIG. 4, a roll sheet receiving portion 21 is defined in the lower portion of the casing 2. A roll sheet R is received in the roll sheet receiving portion 21 through the opening portion 9. The roll sheet receiving portion 21 includes a guide plate 22 configured to hold the roll sheet R. An inner surface of the guide plate 22 and an inner surface of the cover 3 (see FIG. 1) hold the roll sheet R so as to cover the roll sheet R. The guide plate 22 has an arc-shaped cross section when seen from the right-and-left direction. The guide plate 22 holds the roll sheet R under a state in which an outer peripheral surface of the roll sheet R is held in contact with an arc-shaped inner peripheral surface of the guide plate 22. The guide plate 22 is configured to guide the recording sheet P, which is drawn out from the roll sheet R, to the printing unit 4.

In the embodiment, the recording sheet P is heat-sensitive sheet. For example, the recording sheet P is suitably used for printing of various labels, receipts, and tickets. The recording sheet P is wound into a roll shape to form the roll sheet R having a hollow hole.

Figure 3:
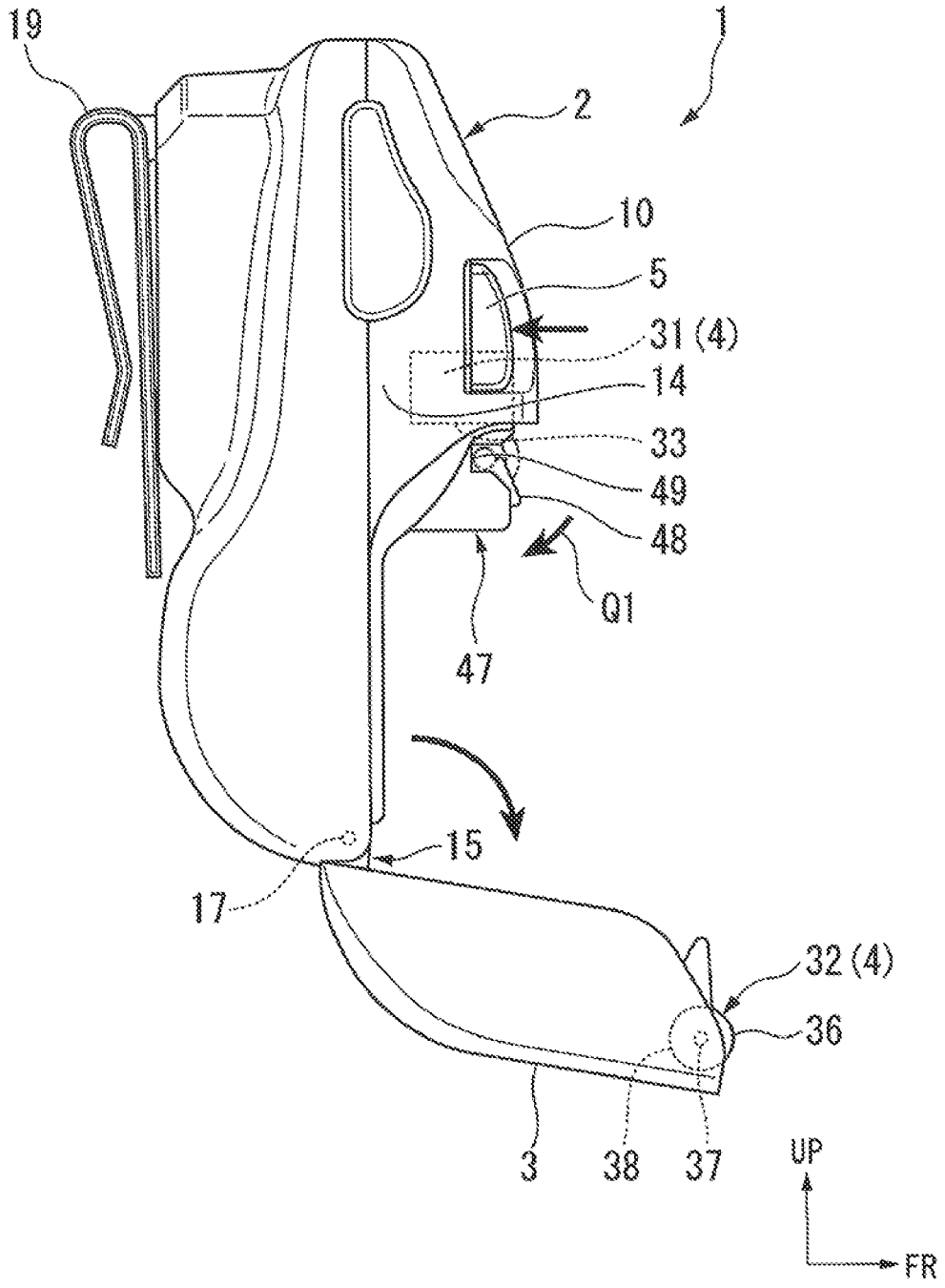
FIG. 3 is a side view of the portable printer according to the embodiment under a state in which the cover takes an opening position.

As illustrated in FIG. 1, the cover 3 forms a lower front surface of the thermal printer 1. For example, the cover 3 is made of a resin material such as polycarbonate. The cover 3 is a covering portion (sheet cover) configured to open and close the opening portion 9 (see FIG. 4). The cover 3 is supported on the casing 2 so as to be pivotable. As illustrated in FIG. 3, owing to a hinge structure 15 provided below the cover 3, the cover 3 is pivotable with respect to the casing 2. The hinge structure 15 is formed by coupling hinge plates 16 (see FIG. 4) and a hinge shaft 17 in a pivotable manner. The hinge plates 16 are formed on the casing 2, and a hinge shaft 17 is provided to the cover 3.

An upper end of the cover 3 is lockable to the casing 2 through intermediation of a platen unit 32. A platen roller 36 is supported on the cover 3 so as to be freely rotatable. At a closed position of the cover 3, a gap defined between an upper edge of the cover 3 and a lower edge of the front wall 10 of the casing 2 forms the delivery port 24 through which the recording sheet P subjected to printing by the printing unit 4 is delivered (see FIG. 1).

As illustrated in FIG. 1, cutting blades 25 are provided at opening edges of the delivery port 24. The cutting blades 25 are configured to cut the recording sheet P delivered through the delivery port 24. The cutting blades 25 are integrally formed at the lower edge of the front wall 10 of the casing 2 (or an upper opening edge portion among the opening edges), and the upper edge of the cover 3, respectively. For example, the recording sheet P is cut by pulling down the recording sheet P toward the cutting blades 25.

Figure 2:
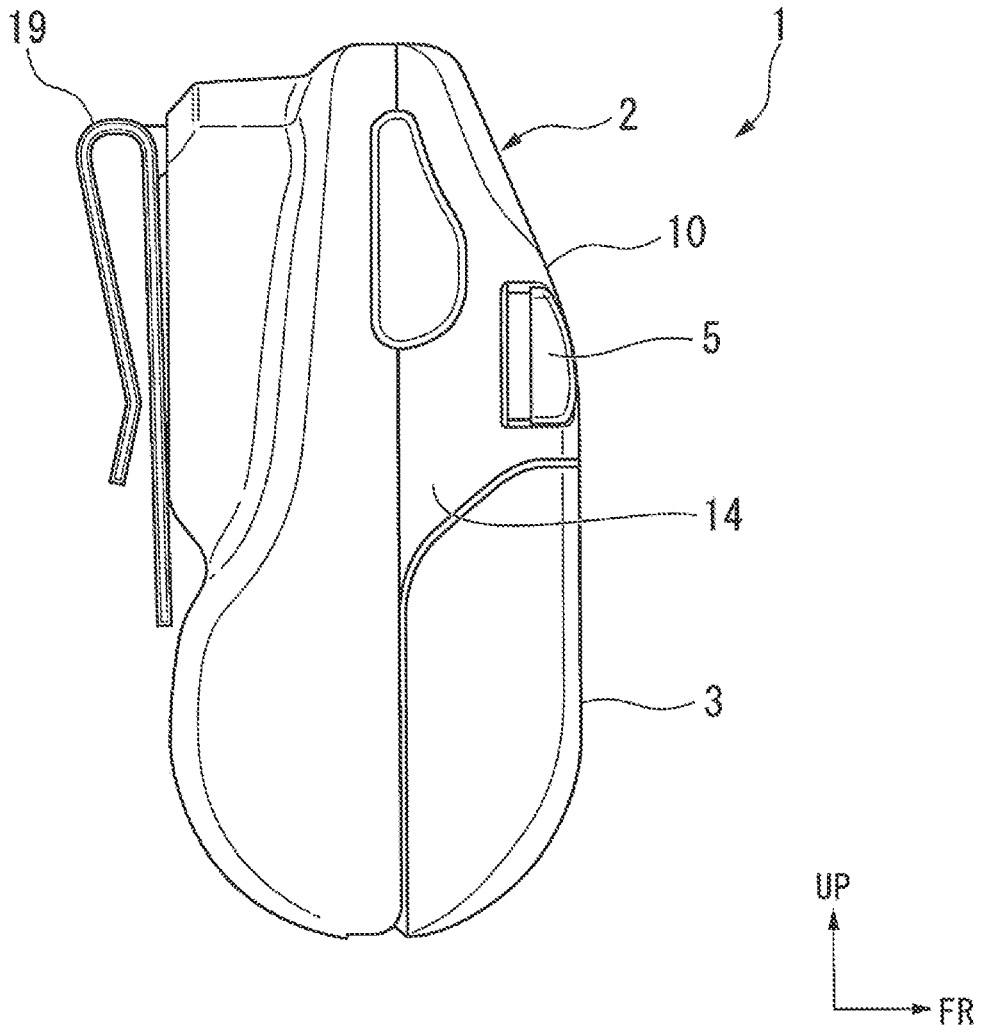
FIG. 2 is a side view of FIG. 1.

As illustrated in FIG. 2, a hook 19 is provided on a back-side upper portion of the casing 2. For example, a strap or a belt is mountable to the hook 19. For example, when a user carries the thermal printer 1, it is assumed that the user often carries the thermal printer 1 under a state in which a strap slung across a shoulder or a waist belt is mounted to the hook 19. Accordingly, the state of the thermal printer 1 having the front-and-rear, up-and-down, and right-and-left directions as illustrated in FIG. 1 corresponds to an assumed carriage state of the thermal printer 1.

As illustrated in FIG. 3, the printing unit 4 is received in the casing 2. The printing unit 4 includes a head unit 31 and the platen unit 32. The printing unit 4 performs printing on a portion of the recording sheet P drawn out from the roll sheet R (see FIG. 4).

The head unit 31 is provided at a lower end portion of the front wall 10 of the casing 2. The head unit 31 includes a thermal head 33 including a plurality of heating elements. The thermal head 33 is connected to, for example, a control unit through a flexible board (not shown). In the thermal head 33, a driver IC (not shown) installed on the thermal head 33 controls generation of heat of the heating elements based on a signal from the control unit. Then, when the recording sheet P passes through the heating elements, printing is performed on the recording sheet P.

The platen unit 32 is provided at an upper end portion (distal end portion) of the cover 3. The platen unit 32 is combined with the head unit 31 so as to be attachable and detachable through opening and closing operation of the cover 3. The platen unit 32 includes a platen frame (not shown) and the platen roller 36. The platen frame is mounted to the cover 3. The platen roller 36 is supported on the platen frame so as to be rotatable.

Under a state in which the cover 3 is closed, the platen roller 36 is arranged so as to be opposed to the thermal head 33. The platen roller 36 is configured to convey the recording sheet P while sandwiching the recording sheet P together with the thermal head 33.

The platen roller 36 includes a platen shaft 37 and a roller main body 38. The platen shaft 37 extends along the right-and-left direction. The roller main body 38 is made of, for example, rubber that is externally fitted to the platen shaft 37. Bearings (not shown) are externally fitted to both end portions of the platen shaft 37, respectively. The bearings are configured to support the platen shaft 37 in a rotatable manner. The platen roller 36 is supported on the platen frame through intermediation of the bearings (not shown) so as to be rotatable.

For example, a platen gear (not shown) is mounted to a right end portion of the platen shaft 37. The head unit 31 includes a train mechanism and a motor. The train mechanism is meshed with the platen gear (not shown). The motor is connected to the train mechanism. When the platen unit 32 and the head unit 31 are combined with each other, the platen gear is meshed with the train mechanism provided on the head unit 31 side, thereby transmitting a rotational drive force of the motor to the platen roller 36. When the platen unit 32 and the head unit 31 are combined with each other, the thermal head 33 of the head unit 31 is brought into press-contact with the outer peripheral surface of the platen roller 36.

As illustrated in FIG. 1, the button 5 is provided in a boundary portion between the front wall 10 and the side wall 14 of the casing 2. The button 5 includes a depression surface 40 on a front surface thereof. The button 5 is an operation portion configured to perform operation of separating the thermal head 33 and the platen roller 36 from each other. The button 5 is an operation portion configured to unlock between the casing 2 and the cover 3, to thereby release the opening portion 9 of the casing 2 (see FIG. 4).

For example, when the button 5 is depressed (pushed rearward in the assumed carriage posture), the locking between the casing 2 and the cover 3 is undone. Thus, the cover 3 is pivoted from the closed position illustrated in FIG. 2 to the opened position illustrated in FIG. 3.

Figure 5:
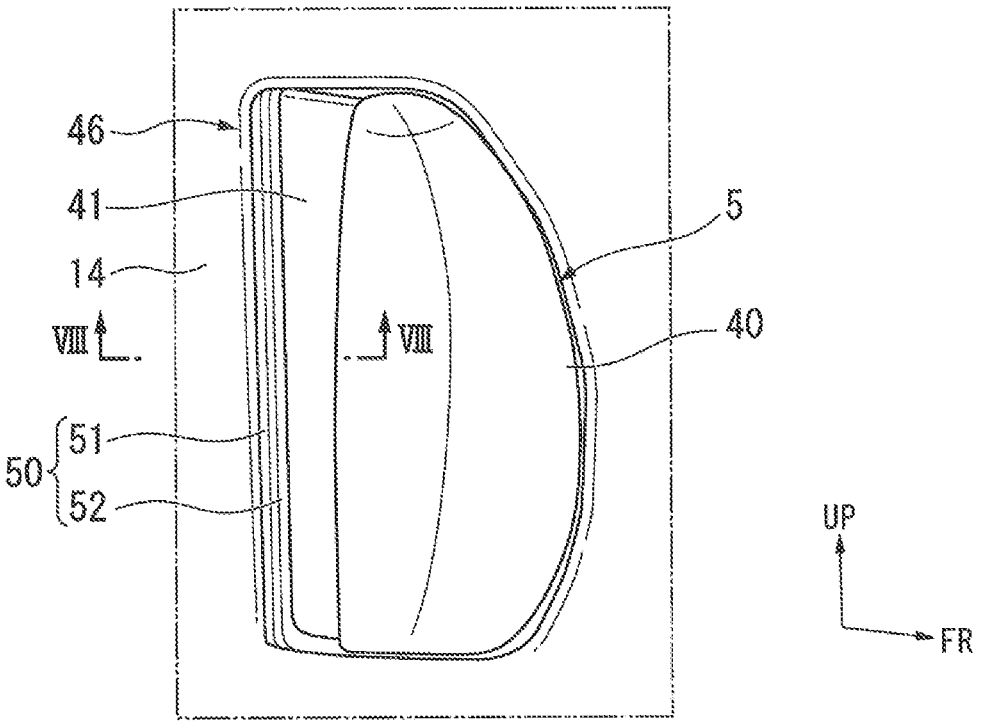
FIG. 5 is a side view of a button of the portable printer according to the embodiment.
Figure 6:
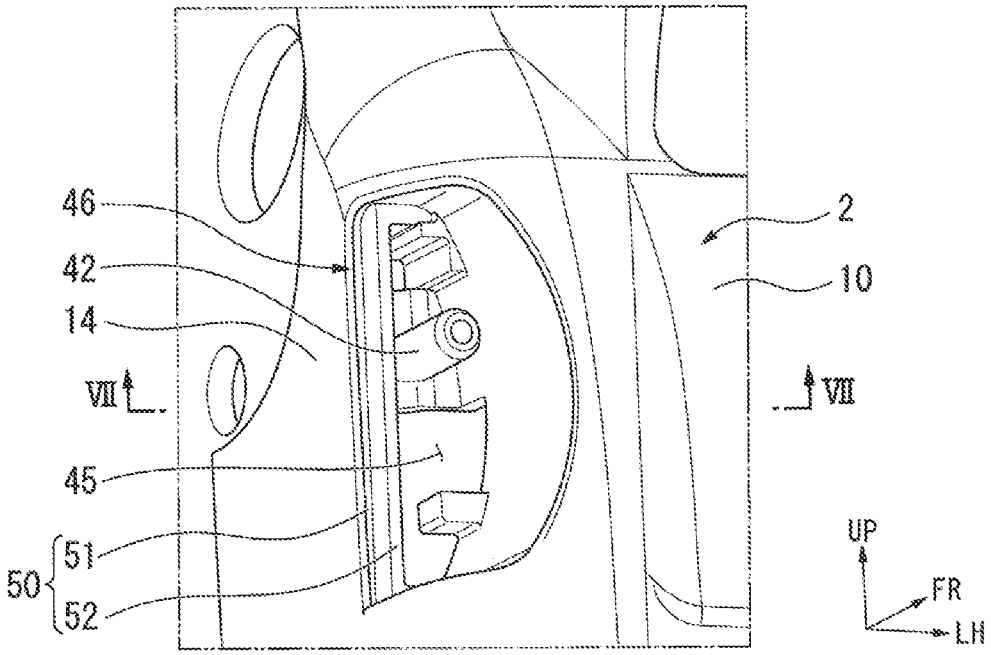
FIG. 6 is a perspective view for illustrating a state in which the button is removed from the portable printer according to the embodiment.

As illustrated in FIG. 6, a receiving portion 45 is formed in the casing 2, and is configured to receive the button 5 (see FIG. 5). The receiving portion 45 has an edge portion 46 extending along an outer peripheral edge of a base portion 41 (see FIG. 5) of the button 5. The receiving portion 45 is hollow so as to link an internal mechanism (not shown) by the button 5. The receiving portion 45 communicates with the inside of the casing 2. A control board (not shown) having, for example, a printer mechanism and an electronic component mounted thereon is provided inside the casing 2. The control board is arranged behind the front wall 10 of the casing 2 (for example, behind the operation unit 11 illustrated in FIG. 1). In FIG. 6, reference symbol 42 denotes a guide pin configured to guide the base portion 41 (see FIG. 5) of the button 5 in the front-and-rear direction.

As illustrated in FIG. 3, a lock mechanism 47 is provided in the casing 2, and is configured to lock the platen roller 36. The lock mechanism 47 includes a lock arm 48 configured to hold the platen roller 36 inserted in a roller insertion groove 49. For example, when the button 5 is depressed, the lock arm 48 is pivoted in a direction indicated by the arrow Q 1 against an urging member (not shown). Then, the lock arm 48 is disengaged from the bearing (not shown) of the platen shaft 37 so that the platen roller 36 is disengaged from the roller insertion groove 49. Thus, the cover 3 can be opened.

As illustrated in FIG. 5, a stepped portion 50 is formed on the casing 2 along a peripheral edge of the button 5, and protrudes so that an inner side of the casing 2 is higher than an outer side of the casing 2. The stepped portion 50 protrudes forward on the inner side (left side) with respect to the side wall 14 (outer surface) of the casing 2. The stepped portion 50 is formed at least at a lowermost portion of the edge portion 46 along a vertical direction of the button 5. The stepped portion 50 is formed across the entire edge portion 46 along the vertical direction of the button 5.

Figure 7:
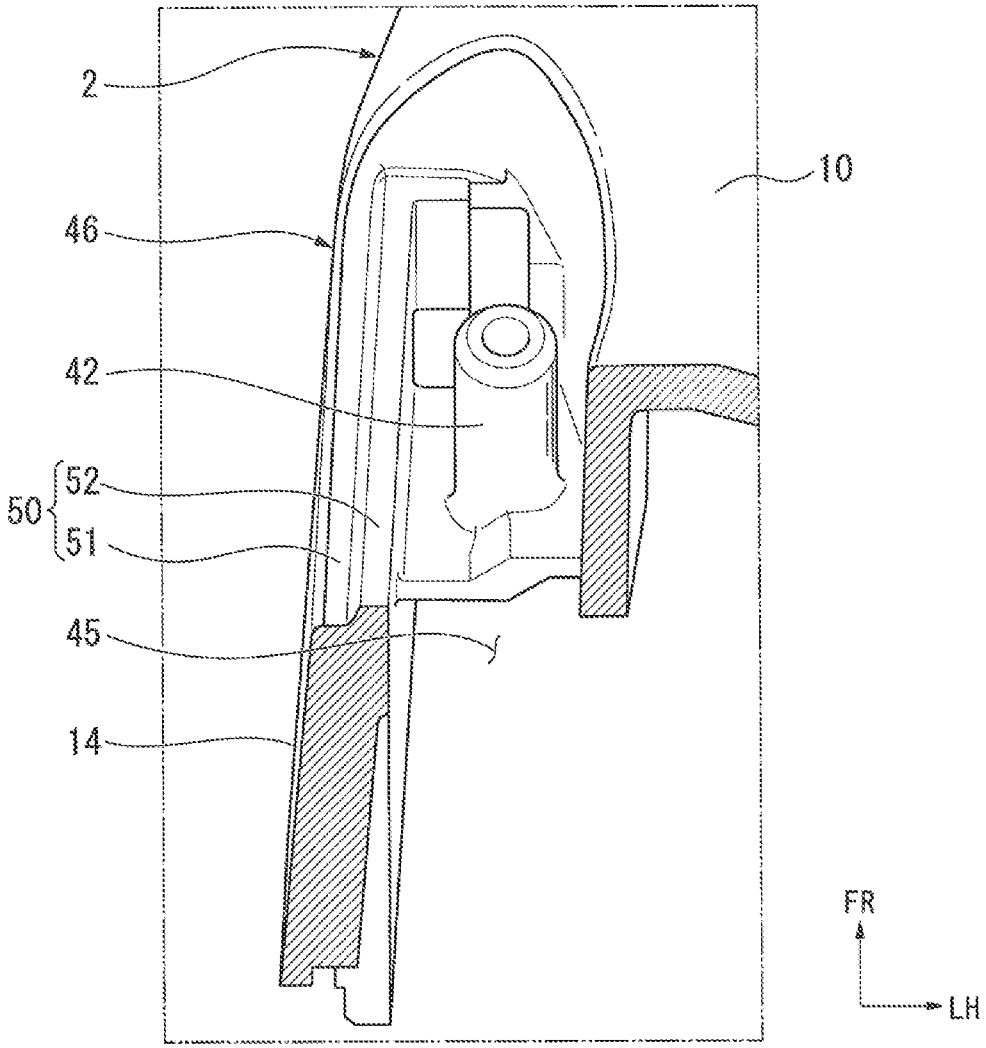
FIG. 7 is a perspective view including a cross section taken along the line VII-VII of FIG. 6.

As illustrated in FIG. 7, the stepped portion 50 includes a landing 51 and a protruding wall 52. The landing 51 is adjacent to the outer surface (side wall 14) of the casing 2. The landing 51 extends across the entire edge portion 46 along the vertical direction of the button 5 (see FIG. 6). The landing 51 has a flat surface substantially parallel to the right-and-left direction (see FIG. 8).

The protruding wall 52 is a projecting portion protruding forward from the landing 51. The protruding wall 52 extends across the entire edge portion 46 along the vertical direction of the button 5 (see FIG. 6). The protruding wall 52 and the landing 51 are integrally formed of the same member. In a sectional view of FIG. 8, the protruding wall 52 and the landing 51 form an L shape together.

Figure 8:
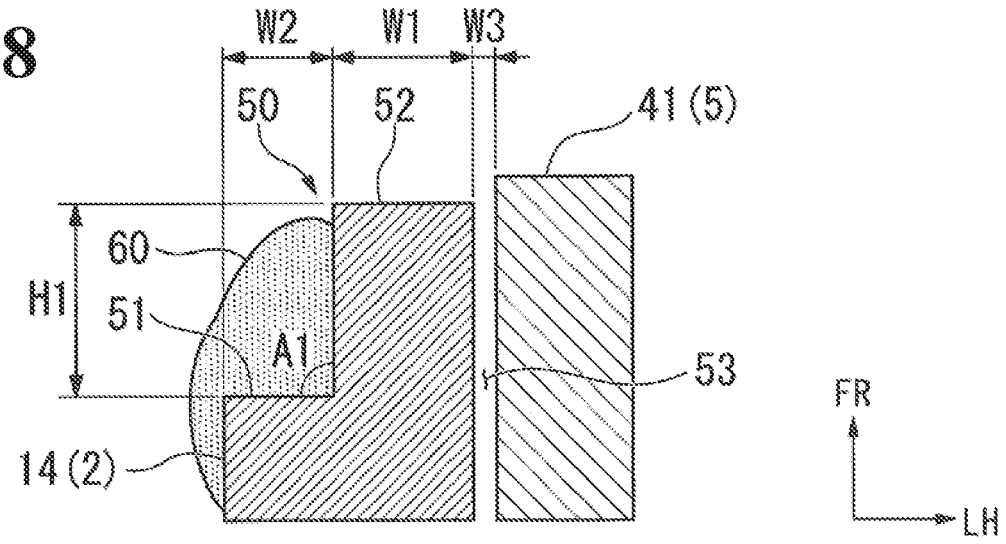
FIG. 8 is an explanatory view of a stepped portion in the embodiment including a cross section taken along the line VIII-VIII of FIG. 5.

As illustrated in FIG. 8, a gap 53 is defined between the protruding wall 52 and the base portion 41 of the button 5. The gap 53 communicates with the inside of the casing. The gap 53 opens a space between the protruding wall 52 and the base portion 41 of the button 5 forward. For example, the gap 53 (or a width W3 of the gap 53) has a size large enough to allow a depressing operation of the button 5 (movement in the assumed carriage posture during position change in the front-and-rear direction) to be performed smoothly.

In the embodiment, a height H1 of the protruding wall 52 is larger than a width W2 of the landing 51 (H1>W2). Here, the height H1 of the protruding wall 52 refers to a protruding amount of the protruding wall 52 protruding forward from the landing 51 under the assumed carriage posture. The width W2 of the landing 51 refers to a length of the flat surface of the landing 51 in the right-and-left direction under the assumed carriage posture.

In the embodiment, a width W1 of the protruding wall 52 is larger than a width W2 of the landing 51 (W1>W2). Here, the width W1 of the protruding wall 52 refers to a length (thickness) of the protruding wall 52 in the right-and-left direction under the assumed carriage posture.

In the embodiment, the width W2 of the landing 51 is larger than the width W3 of the gap 53 (W2>W3). Here, the width W3 of gap 53 refers to a distance in the right-and-left direction between the protruding wall 52 and the base portion 41 of the button 5 under the assumed carriage posture.

In the embodiment, an angle A1 formed between the landing 51 and the protruding wall 52 is a substantially right angle (A1≈90°). Here, the angle A1 refers to an angle formed between a flat surface of the landing 51 and an outer surface of the protruding wall 52 under the assumed carriage posture.

Figure 9:
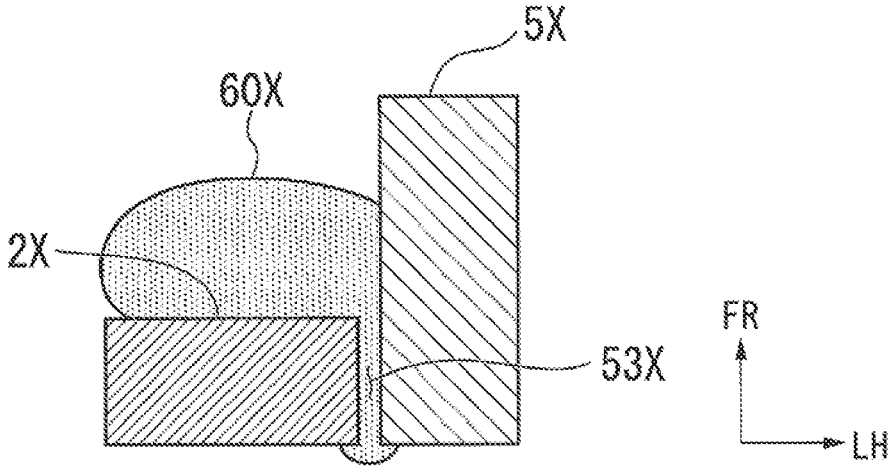
FIG. 9 is an explanatory view of a peripheral edge portion of a button in a comparative example.

Next, actions of the stepped portion 50 are described together with a comparative example. FIG. 9 is an explanatory view of a peripheral edge portion of the button in the comparative example. In the comparative example, the stepped portion 50 (see FIG. 8) in the embodiment is not provided. For example, rainwater during outdoor work, or liquid (a waterdrop 60X) such as water adhering to a hand of a user may sometimes remain in a boundary portion between a casing 2X and a button 5X. In the comparative example, the waterdrop 60X is held in contact with the casing 2X and the button 5X. Due to surface tension, the waterdrop 60X maintains a spherical shape while being held in contact with the casing 2X and the button 5X. There is a risk in that the waterdrop 60X remaining in the boundary portion between the casing 2X and the button 5X flows into the casing 2X through a gap 53X between the casing 2X and the button 5X.

FIG. 8 is an explanatory view of the stepped portion 50 in the embodiment. In the embodiment, the stepped portion 50 includes the landing 51 adjacent to the outer surface (side wall 14) of the casing 2, and the protruding wall 52 protruding forward from the landing 51. Accordingly, the rainwater accompanied during outdoor work, or the liquid (a waterdrop 60) such as water adhering to a hand of a user tends to remain in a boundary portion between the landing 51 and the protruding wall 52. In the embodiment, the waterdrop 60 is not held in contact with the button 5, but is held in contact with the landing 51 and the protruding wall 52. The waterdrop 60 remaining in the boundary portion between the landing 51 and the protruding wall 52 flows downward along the landing 51. Thus, a risk of inflow of the waterdrop 60 into the gap 53 between the protruding wall 52 and the button 5 (risk of inflow into the casing 2) is low.

As described above, a thermal printer 1 of this embodiment includes a casing 2 configured to receive a recording sheet; a thermal head 33 configured to perform printing on the recording sheet; a platen roller 36, which is arranged so as to be opposed to the thermal head 33, and is configured to convey the recording sheet while sandwiching the recording sheet together with the thermal head 33; a button 5, which is provided on the casing 2, and is configured to perform operation of separating the thermal head 33 and the platen roller 36 from each other; and a stepped portion 50, which is formed on the casing 2 along a peripheral edge of the button 5, and protrudes so that an inner side of the casing 2 is higher than an outer side of the casing 2.

According to the embodiment, the stepped portion 50 is formed on the casing 2 along the peripheral edge of the button 5, and protrudes so that the inner side of the casing 2 is higher than the outer side of the casing 2. Thus, inflow of the liquid into the casing 2 from an outside can be blocked. Therefore, inflow of the liquid into the printer from the outside can be suppressed. In addition, as compared to a case of using, for example, a waterproof cover or a water-repellent oil, drip-proof performance can be enhanced at low cost. Moreover, as compared to a case of using the water-repellent oil, prevention effects are not degraded due to degradation over time, and hence the present invention is preferred.

Further, in this embodiment, in an assumed carriage posture in which a depression surface 40 of the button 5 is positioned beside a front wall 10 of the casing 2, the stepped portion 50 is formed at least at a lowermost portion of an edge portion 46 of the casing 2 along a vertical direction of the button 5.

According to the embodiment of the present invention, the stepped portion 50 is formed at least at the lowermost portion of the edge portion 46 along the vertical direction of the button 5. Thus, at a portion at which the liquid is liable to remain the most due to an action of gravity, inflow of the liquid into the casing 2 from the outside can be blocked. Therefore, inflow of the liquid into the printer from the outside can be suppressed further effectively.

Further, in this embodiment, the assumed carriage posture, the stepped portion 50 is formed across the entire edge portion 46 along the vertical direction of the button 5.

According to the embodiment of the present invention, as compared to a case in which the stepped portion 50 is formed at only part of the edge portion 46 along the vertical direction of the button 5, inflow of the liquid into the casing 2 from the outside can be blocked further effectively.

Further, in this embodiment, in the assumed carriage posture, the button 5 is provided in a boundary portion between the front wall 10 and a side wall 14 of the casing 2.

According to the embodiment of the present invention, even when the liquid flows toward the button 5 along the front wall 10 or the side wall 14 of the casing 2, the stepped portion 50 can block inflow of the liquid into the casing 2. In addition, as compared to a case in which the button 5 is provided on any one of the front wall 10 and the side wall 14 of the casing 2, the present invention contributes to improvement in usability of the button 5. Moreover, as compared to a case in which the button 5 is provided only on the front wall 10 of the casing 2, the present invention contributes to an improvement in delivering performance for the recording sheet.

Further, in this embodiment, the stepped portion 50 includes a landing 51 adjacent to an outer surface of the casing 2; and a protruding wall 52 protruding from the landing 51.

According to the embodiment of the present invention, with a simple configuration in which the stepped portion 50 includes the landing 51 and the protruding wall 52, inflow of the liquid into the casing 2 from the outside can be blocked.

Further, in this embodiment, a height H1 of the protruding wall 52 is larger than a width W2 of the landing 51

According to the embodiment of the present invention, as compared to a case in which the height H1 of the protruding wall 52 is equal to or smaller than the width W2 of the landing 51, the liquid is less liable to flow beyond the protruding wall 52. The liquid is liable to overflow from the landing 51 before flowing beyond the protruding wall 52, and hence inflow of the liquid into the casing 2 from the outside can be blocked further effectively.

Further, in this embodiment, a width W1 of the protruding wall 52 is larger than a width W2 of the landing 51.

According to the embodiment of the present invention, as compared to a case in which the width W1 of the protruding wall 52 is equal to or smaller than the width W2 of the landing 51, the liquid is less liable to flow beyond the protruding wall 52. The liquid is liable to overflow from the landing 51 before flowing beyond the protruding wall 52, and hence inflow of the liquid into the casing 2 from the outside can be blocked further effectively.

Further, in this embodiment, a gap 53 is defined between the protruding wall 52 and the button 5, and wherein the width W2 of the landing 51 is larger than a width W3 of the gap 53.

According to the embodiment of the present invention, as compared to a case in which the width W2 of the landing 51 is equal to or smaller than the width W3 of the gap 53, the liquid is less liable to flow into the gap 53. The liquid is liable to overflow from the landing 51 before flowing into the gap 53, and hence inflow of the liquid into the casing 2 from the outside can be blocked further effectively.

Further, in this embodiment, the portable printer further includes a cover 3 configured to support the platen roller 36 in a freely rotatable manner; and a lock mechanism 47, which is provided in the casing 2, and is configured to lock the platen roller 36, wherein the casing 2 supports the thermal head 33, and wherein the button 5 is capable of undoing locking of the lock mechanism 47.

With this configuration, in the configuration in which the thermal head 33 and the platen roller 36 are separable from each other along with opening and closing of the cover 3, inflow of the liquid into the printer from the outside can be suppressed.

Modification Example

Note that, the technical scope of the present invention is not limited to the above-mentioned embodiment, but various modifications may be made without departing from the gist of the present invention.

Figure 10:
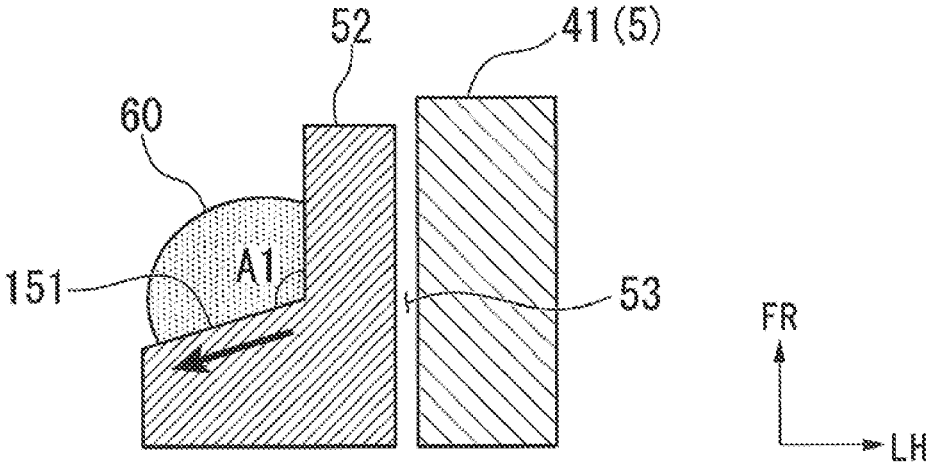
FIG. 10 is an explanatory view of a stepped portion in a modification example of the embodiment.

In the embodiment described above, description is made of the configuration in which the angle A1 formed between the landing 51 and the protruding wall 52 is the right angle, but the present invention is not limited thereto. For example, as illustrated in FIG. 10, the angle A1 formed between a landing 151 and the protruding wall 52 may be an obtuse angle. The landing 151 may be inclined in a sectional view so that a left end of the landing 151 (flat surface) is located on the front side and a right end of the landing 151 (flat surface) is located on the rear side. With this configuration, the water-drop 60 easily flow along the inclination of the landing 151.

In this modification example, an angle A1 formed between the landing 151 and the protruding wall 52 is an obtuse angle.

According to the modification example of the present invention, as compared to a case in which the angle A1 formed between the landing 51 and the protruding wall 52 is an acute angle, the liquid is less liable to remain on the landing 151. The liquid easily flow along the inclination of the landing 151, and hence inflow of the liquid into the casing 2 from the outside can be blocked further effectively.

In the embodiment described above, description is made of the configuration in which the stepped portion 50 is formed across the entire edge portion 46 along the vertical direction of the button 5 under the assumed carriage posture, but the present invention is not limited thereto. For example, the stepped portion 50 may be formed only at the lowermost portion of the edge portion 46 along the vertical direction of the button 5. In addition, the stepped portion 50 may be formed on at least one of an upper edge portion and a lower edge portion of the peripheral edge portion of the button 5 along a horizontal direction of the button 5.

In the embodiment described above, description is made of the configuration in which the width W1 of the protruding wall 52 is larger than the width W2 of the landing 51 (W1>W2), but the present invention is not limited thereto. For example, the width W1 of the protruding wall 52 may be equal to or smaller than the width W2 of the landing 51 (W1≤W2).

In the embodiment described above, description is made of the configuration in which the stepped portion 50 includes one protruding wall 52 protruding from the landing 51 (configuration in which only single stepped portion 50 is formed), but the present invention is not limited thereto. For example, the stepped portion may include a plurality of protruding walls protruding from the landing. That is, the stepped portion may have the stepwise structure.

In the embodiment described above, description is made of the configuration in which the protruding wall 52 and the landing 51 are integrally formed of the same member, but the present invention is not limited thereto. For example, the protruding wall 52 and the landing 51 may be formed of different members and integrated with each other.

In the embodiment described above, description is made of the case in which the thermal printer is used as an example of the portable printer, but the present invention is not limited thereto. For example, the portable printer may be applied to various printers other than a thermal printer of a dot impact type.

Besides the above, the components in the above-mentioned embodiments may be replaced by well-known components as appropriate without departing from the gist of the present invention.

What is claimed is:

1. A portable printer, comprising:

a casing configured to receive a recording medium;

a head configured to perform printing on the recording medium;

a platen roller, which is arranged so as to be opposed to the head, and is configured to convey the recording medium while sandwiching the recording medium together with the head;

a button, which is provided on the casing, and is configured to perform operation of separating the head and the platen roller from each other; and a stepped portion, which is formed on the casing along a peripheral edge of the button, and protrudes so that an inner side of the casing is higher than an outer side of the casing;

wherein the button is provided in a boundary portion between a front wall and a side wall of the casing;

wherein the stepped portion includes:

a landing adjacent to an outer surface of the side wall of the casing; and a protruding wall protruding from the landing; and wherein a height of the protruding wall is larger than a width of the landing from the protruding wall to the outer surface of the side wall of the casing.

2. The portable printer according to claim 1, wherein in an assumed carriage posture in which a depression surface of the button is positioned beside the front wall of the casing, the stepped portion is formed at least at a lowermost portion of an edge portion of the casing along a vertical direction of the button.

3. The portable printer according to claim 2, wherein in the assumed carriage posture, the stepped portion is formed across the entire edge portion along the vertical direction of the button.

4. The portable printer according to claim 1, wherein a width of the protruding wall is larger than a width of the landing.

5. The portable printer according to claim 4, wherein a gap is defined between the protruding wall and the button, and wherein the width of the landing is larger than a width of the gap.

6. The portable printer according to claim 5, wherein an angle formed between the landing and the protruding wall is an obtuse angle.

7. The portable printer according to claim 6, further comprising:

a cover configured to support the platen roller in a freely rotatable manner; and a lock mechanism, which is provided in the casing, and is configured to lock the platen roller, wherein the casing supports the head, and wherein the button is capable of undoing locking of the lock mechanism.

8. The portable printer according to claim 1, further comprising:

a cover configured to support the platen roller in a freely rotatable manner; and a lock mechanism, which is provided in the casing, and is configured to lock the platen roller, wherein the casing supports the head, and wherein the button is capable of undoing locking of the lock mechanism.

* * * * *